US005983951A

United States Patent [19]

Taniguchi et al.

[11] Patent Number: 5,983,951

[45] Date of Patent: Nov. 16, 1999

[54] WEAR RESISTANT LOOM PART AND LOOM COMPRISING THE SAME

[75] Inventors: Junji Taniguchi; Kazuya Tsujimoto, both of Yokohama; Hideo Koizumi, Yokosuka; Yasuhisa Shiraishi, Tokyo, all of Japan

[73] Assignee: Kabushiki Kaisha Toshiba, Kawasaki, Japan

[21] Appl. No.: 08/910,054

[22] Filed: Aug. 12, 1997

[30] Foreign Application Priority Data

Aug. 12, 1996 [JP] Japan ..... 8-212320

[51] Int. Cl.[6] ..... D03D 49/62

[52] U.S. Cl. ..... 139/1 R; 139/93; 139/192; 148/325

[58] Field of Search ..... 148/325; 139/192, 139/93, 1 R

[56] References Cited

U.S. PATENT DOCUMENTS

| | | | |
|---|---|---|---|
| 4,584,034 | 4/1986 | Hagiwara et al. | 148/31 |
| 4,908,261 | 3/1990 | Ishii et al. | 128/216 |
| 5,178,693 | 1/1993 | Miyakusu et al. . | |
| 5,348,055 | 9/1994 | Kramer | 139/93 |
| 5,447,181 | 9/1995 | Tahara et al. | 139/192 |
| 5,483,997 | 1/1996 | Corain et al. | 139/194 |
| 5,511,587 | 4/1996 | Miya et al. | 139/192 |
| 5,624,504 | 4/1997 | Miyakusu et al. . | |
| 5,658,394 | 8/1997 | Meroth | 148/222 |
| 5,758,696 | 6/1998 | Nishikawa | 139/1 R |

FOREIGN PATENT DOCUMENTS

| | | |
|---|---|---|
| 3-56621 | 3/1991 | Japan . |
| 5-33244 | 2/1993 | Japan . |
| 5-171282 | 7/1993 | Japan . |
| 5-72449 | 10/1993 | Japan . |
| 7-138704 | 5/1995 | Japan . |

*Primary Examiner*—Andy Falik
*Attorney, Agent, or Firm*—Foley & Lardner

[57] ABSTRACT

A wear-resistant and corrosion-resistant loom part comprises a Fe—Cr based alloy or a Fe—Cr—Ni based alloy, which has a substantially dual-phase structure comprising a ferrite phase and a martensite phase. The Fe—Cr based alloy preferably contains 10 to 20% by weight Cr, and contains 5 to 70 volume % of the ferrite phase in its structure. The Fe—Cr—Ni based alloy preferably contains 10 to 30% by weight of Cr, 0.01 to 15% by weight of Ni, and 5 to 70 volume % of the ferrite phase in its structure. The maximum crystal particle diameter of the Fe—Cr based alloy or the Fe—Cr—Ni based alloy is preferably 20 $\mu$m or less. The loom part is preferably formed of either a dent of a reed or a heddle.

31 Claims, 1 Drawing Sheet

WEAR RESISTANT LOOM PART AND LOOM COMPRISING THE SAME

BACKGROUND OF THE INVENTION

1. Field of the Invention

The present invention relates to parts of loom and a loom therewith, the part being made of an alloy suitable for dents of read, a heddle, and the like that slide and contact threads.

2. Description of the Related Art

Conventionally, cloth is woven by a loom in the following manner. A woof thread is inserted among a plurality of warp threads by the power of water (water jet loom) or compressed air (air jet loom). The woof thread is pressed. By repeating these steps, cloth is formed. The cloth is wound as woven cloth by a take-up roll.

A part that pushes a woof thread is called dents of reed. A dent is formed in a thin knife shape. A number of dents are arranged in a comb shape. These dents are secured with a rectangular frame. The resultant structure is referred to as a reed. Warp threads are inserted among the dents of reed and woven. A part that arranges a warp thread is termed a heddle. The heddle has a thread hole at the center position. A number of heddles are arranged in parallel and disposed on the frame. By integrally moving the arranged heddles, the warp threads in the thread holes are vertically reciprocated.

The dents of loom and heddles are in contact with the warp threads and woof threads. Thus, these parts should have wear resistance against the warp threads and woof thread.

In addition, when a water jet loom or an air jet loom is used, the dents of reed and heddles should have excellent corrosion resistance. Thus, as structural materials of dents of loom and heddles, an austenite type stainless material (for example, SUS 301 equivalent to AISI 301) and a martensite type stainless material (for example, SUS 420 J2 equivalent to ISO 683-13 5) have been widely used. In a water jet loom a ferrite type stainless material (for example, SUS 430 equivalent to AISI 430) has been used.

In the following description, it is assumed that the material SUS 301 has been cold-worked. The material SUS 301 is composed of 17% by weight of Cr, 7% by weight of Ni, and balance of Fe. The SUS 301 has a structure of an austenite phase and a martensite phase. The SUS 420 J2 is composed of around 13% by weight of Cr, 0.3% by weight of C, and balance of Fe. The material SUS 420 J2 has a structure of a martensite phase. The material SUS 430 is composed of 18% by weight of Cr and balance of Fe. The material SUS 430 has a structure of a ferrite phase.

In recent years, high speed weaving operations have been required. As the speed of the weaving operation becomes high and an environment of the weaving operation becomes severe, requirements of loom parts such as dents of reed and heddles have become strict. In other words, parts of loom should have excellent wear resistance, corrosion resistance, and resistance to permanent set in fatigue. Under severer conditions, the long service lives of the parts of loom are required.

However, the above-described conventional stainless materials have not sufficient characteristics suitable for the loom parts. For example, the material SUS 301 has relatively good corrosion resistance and resistance to permanent set in fatigue, but has not sufficient wear resistance. Owing to this insufficient wear resistance, loom parts using SUS 301 cause clothes to nap or thread to cut in a relatively early stage of weaving operation. In addition, since the material SUS 301 has high hardness, the press mold for molding the loom parts is worn away early.

On the other hand, although the material SUS 420 J2 has almost good wear resistance and resistance to permanent set in fatigue, it does not have sufficient corrosion resistance. Thus, the material SUS 420 J2 tends to corrode. Occurrence of corrosion shortens the service lives of the parts of loom. In addition, although the material SUS 430 has good corrosion resistance, it does not have sufficient resistance to permanent set in fatigue. Thus, the material SUS 430 causes cloth to grain rise. Although the material SUS 430 has intermediate wear resistance of those of the materials SUS 420 J2 and SUS 301, the wear resistance of the material SUS 430 is not sufficient for a part of loom this is required to have long service life.

Thus, stainless materials that have been used as parts of loom do not have long service lives. In particular, as high speed weaving operation and severe manufacturing environment have been required, short service lives of parts of loom are becoming a problem to be solved.

SUMMARY OF THE INVENTION

Therefore, an object of the present invention is to improve the wear resistance against threads, satisfy corrosion resistance corresponding to a manufacturing environment of cloth, and improve the resistance to permanent set in fatigue so as to provide parts of loom that have long service lives. In particular, an object of the present invention is to provide parts of loom that have long service lives under severe conditions such as high speed weaving operation and severe manufacturing environment. Another object of the present invention is to provide a loom using such parts so as to satisfy severe conditions such as high speed weaving operation and severe manufacturing environment.

Through intensive study of the inventors of the present invention, they found that parts of loom get worn with threads that are very soft materials in a long time operation. Thus, as points to be considered, wear in the depth direction (in parallel with threads) and wear in the lateral direction (perpendicular to threads) are important. In other words, the amount of wear does not simply means the service lives of parts of loom. When parts get worn in the lateral direction, wear of a limited portion can be prevented. Thus, long service lives of the parts of loom can be accomplished. Secondly, since paste of threads adheres to the parts of loom, the paste causes the parts to corrode. Thus, the corrosion due to the paste should be suppressed. This point is unique in the parts of loom.

With these points, intensive study of the inventors of the present invention show that the wear in the depth direction of the parts of loom made of the stainless material SUS 301 is much larger than the wear in the lateral direction. In other words, the parts of loom made of an austenite type stainless material (SUS 301) have very large wear (wear of limited portion) in the depth direction, causing threads to cut and the surface thereof to become unsmooth.

On the other hand, although the martensite type stainless material (SUS 420 J2) almost satisfies wear resistance, it does not have sufficient corrosion resistance. Thus, this material tends to corrode. Although the ferrite type stainless material (SUS 430) gets worn in the depth direction, it also gets worn in the lateral direction. Thus, since wear of a limited portion is suppressed, the ferrite type stainless material (SUS 430) has intermediate wear resistance of those of the austenite type stainless material (SUS 301) and the martensite type stainless material (SUS 420 J2). However, since the ferrite type stainless material (SUS 430) does not have sufficient resistance to permanent set in fatigue, it causes cloth to grain-rise as the material is used.

In consideration of the problems of the conventional materials, the inventors of the present invention evaluated compositions and metal structures that are different from those of the conventional austenite type stainless material (SUS 301), martensite type stainless material (SUS 420 J2), and ferrite type stainless material (SUS 430). The evaluated results show that substantially dual-phase of a ferrite phase and a martensite phase as a metal structure of a Fe—Cr based alloy or a Fe—Cr—Ni based alloy allows wear to progress in the lateral direction and thereby suppresses wear in the depth direction. In addition, this metal structure satisfies the corrosion resistance as parts of loom. Moreover, this metal structure satisfies the resistance to permanent set in fatigue. When the maximum crystal particle diameter of the Fe—Cr based alloy or Fe—Cr—Ni based alloy is 20 $\mu$m or less, wear of a limited portion of the alloy can be suppressed.

The Fe—Cr based alloy or Fe—Cr—Ni based alloy that substantially has dual-phase of a ferrite phase and a martensite phase has been used for a material of springs that are completely different from parts of loom (as disclosed in Japanese Patent Laid-Open Application Nos. 3-56621, 5-171282, and 7-138704). Although the Fe based alloy substantially having dual-phase of a ferrite phase and a martensite phase is suitable for the material of springs, the wear amount thereof is inferior to that of the stainless material SUS 420 J2. However, when the Fe based alloy is used for parts of loom, wear thereof progresses in the lateral direction, thereby suppressing wear of a limited portion thereof. This alloy is superior to the material in preventing threads from cutting and cloth from napping. In addition, this alloy has excellent corrosion resistance.

The present invention is made from the above-described point of view.

A first aspect of the present invention is a part of loom, the part being composed of a Fe—Cr based alloy having a structure of substantially dual-phase of a ferrite phase and a martensite phase. From a corrosion resistance point of view, the Fe—Cr based alloy preferably has 10 to 30% by weight of Cr. In addition, the Fe—Cr based alloy preferably contains at least one selected from the group consisting of Mn, Co, Cu, and Pt, the content of the selected element(s) being in the range from 0.01 to 20% by weight. Alternatively, the Fe—Cr based alloy preferably contains 0.0001 to 1% by weight of N.

A second aspect of the present invention is a part of loom, the part being composed of a Fe—Cr—Ni based alloy having a structure of substantially dual-phase of a ferrite phase and a martensite phase. From corrosion resistance, hardness, and wear resistance points of view, the Fe—Cr—Ni alloy preferably contains 10 to 30% by weight of Cr and 0.01 to 15% by weight of Ni. In addition, another aspect of the present invention is a part of loom, the part composed of a Fe—Cr—Ni based alloy containing at least 10 to 30% by weight of Cr and 0.01 to 15% by weight of Ni and the Fe—Cr—Ni based alloy being heated and then rapidly cooled at a cooling speed of 1 to 1000 K/sec.

A third aspect of the present invention is a part of loom, the part composed of a Fe—Cr based alloy or a Fe—Cr—Ni based alloy, the maximum crystal particle diameter of the Fe—Cr based alloy or the Fe—Cr—Ni alloy being 20 $\mu$m or less.

A loom according to the present invention comprises a cloth beam for supplying a plurality of warp threads, a plurality of heddles, having respective thread holes for the warp threads, for vertically reciprocating the warp threads, a thread supplying means for supplying a woof thread among the warp threads, and a plurality of dents of reed for pushing the woof thread, the dents of reed. At least either heddles or dents of reed are composed of the part of loom according to the present invention.

These and other objects, features and advantages of the present invention will become more apparent in light of the following detailed description of best mode embodiments thereof, as illustrated in the accompanying drawings.

DETAILED DESCRIPTION OF THE PREFERRED EMBODIMENT

Figure 1:
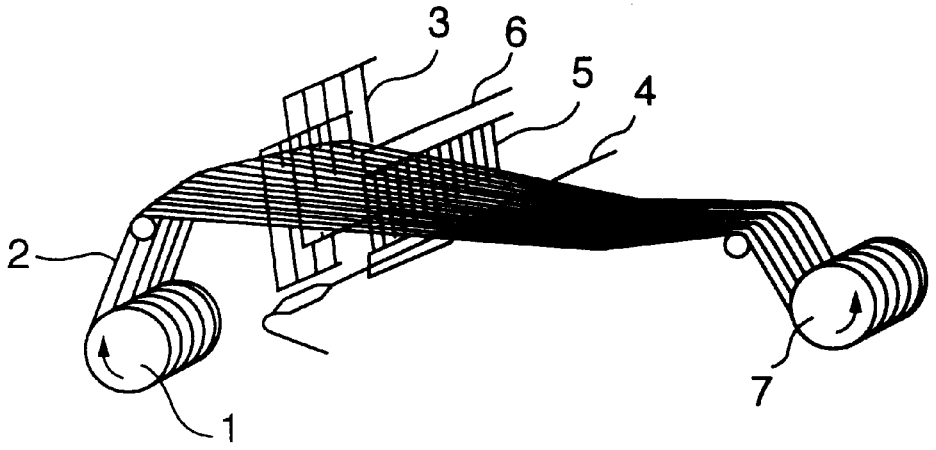
FIG. 1 is a schematic diagram showing the structure of a loom according to an embodiment of the present invention.

The first aspect of the present invention is a part of loom, the part being composed of a Fe—Cr based alloy having a structure of substantially dual-phase of a ferrite phase and a martensite phase.

The Fe—Cr based alloy preferably has 10 to 30% by weight of Cr.

Cr contributes to improving the corrosion resistance of parts of loom. When the amount of Cr is too large, working characteristics degrade. In contrast, when the amount of Cr is too small, sufficient corrosion resistance cannot be obtained and the ratio of the ferrite phase and the martensite is adversely affected. The amount of Cr is more preferably in the range from 13% by weight to 19% by weight.

The Fe—Cr based alloy preferably contains at least one selected from the group consisting of Mn, Co, Cu, and Pt, the content of the selected element(s) being in the range from 0.01 to 20% by weight. Alternatively, the Fe—Cr based alloy preferably contains 0.0001 to 1% by weight of N. These elements contribute to increasing the amount of the martensite phase and improving hardness and wear resistance. However, when the amounts of these elements are too large, since the amount of the martensite layer becomes large, the ductility thereof degrades. In addition, since the relative amount of the ferrite phase decreases, the corrosion resistance may degrade. Thus, the content of the elements of the austenite phase is preferably 15% by weight or less, further preferably 10% by weight or less.

The Fe—Cr based alloy preferably contains 0.001 to 1% by weight of C. C contributes to further improving wear resistance. When the amount of C is contained in the above-described range, the martensite phase is reinforced. The amount of C is more preferably in the range from 0.04 to 0.08% by weight, further preferably in the range from 0.06 to 0.07% by weight.

The Fe—Cr based alloy may contain a small amount of silicon (Si) or the like. Si allows the amount of the ferrite phase to increase, thereby effectively controlling the martensite phase. When the amount of Si is too large, the hot working characteristics and cold working characteristics degrade. Thus, the amount of Si is preferably 2.0% by weight or less.

The Fe—Cr based alloy may contain Al, Mg, Ca, Ti, or the like as a deoxidizing agent. In addition, the Fe—Cr based alloy may contain Nb, Ta, Zr, Mo, RE (rare earth element), Y, or B so as to improve working characteristics and heat resistance. Moreover, the Fe—Cr based alloy may contain a small amount of P, S, or O as impurities.

After the Fe—Cr based alloy is heated to a temperature of the region of dual-phase of a ferrite phase and a austenite phase, it is rapidly cooled and thereby the austenite phase is changed to the martensite phase. Thus, a Fe—Cr based alloy having a metal structure of substantially dual-phase of the ferrite phase and the martensite phase is obtained. The ferrite phase contributes to improving the corrosion resistance. On the other hand, the martensite phase contributes to improving the hardness, wear resistance, resistance to permanent set in fatigue, and so forth.

The hardness and wear resistance of the ferrite phase are inferior to those of the martensite phase. However, when a composite structure of the ferrite phase and the martensite phase is used for parts of loom, since the structure causes threads to slide in the lateral direction, wear of the resultant alloy progresses in the lateral direction. This feature is effective to suppress wear of a limited portion.

Thus, when the Fe—Cr based alloy having a metal structure of substantially dual-phase of the ferrite phase and the martensite phase gets worn with threads, the martensite phase suppresses wear of the ferrite phase. In addition, the martensite phase causes wear to progress in the lateral direction. Thus, wear of a limited portion that causes threads to cut and cloth to grain-rise can be suppressed. Moreover, the martensite phase contributes to improving the resistance to permanent set in fatigue. An alloy composition containing Cr and the ferrite phase sufficiently satisfy the corrosion resistance necessary for parts of loom. Thus, under severe conditions such as high speed weaving operation and severe manufacturing environment, long service lives of parts of loom can be accomplished.

The Fe—Cr based alloy preferably contains 5 to 70% by volume or area of random cross section of the ferrite phase. At this point, the rest is the martensite phase. The volume of each phase is obtained by measuring continuously the cross-sectional area being parallel to the random cross section. The volume of each phase is about equal to the cross-sectional area of each phase, because the ferrite phase and the martensite phase exist uniformly in the Fe—Cr based alloy as a whole part.

When the amount of the ferrite phase is less than 5% by volume or cross-sectional area, sufficient corrosion resistance for parts of loom cannot be obtained. In contrast, when the amount of the ferrite phase exceeds 70% by volume or cross-sectional area, since the ratio of the martensite phase relatively decreases, the wear resistance and resistance to permanent set in fatigue for parts of loom become insufficient. To satisfy both the mechanical characteristics such as wear resistance and resistance to permanent set in fatigue and the corrosion resistance for parts of loom, the ratio of these phases is preferably in the above-described range. More preferably, the amount of the ferrite phase is in the range from 15 to 40% by volume or cross-sectional area.

Although the parts of loom according to the first aspect of the present invention have a structure of substantially dual-phase of the ferrite phase and the martensite phase, even if the structure contains a small amount of an austenite phase, the wear resistance and the corrosion resistance of the parts do not largely degrade. Thus, the structure may have the austenite phase less than 5% by volume or cross-sectional preferably less than 1% by volume or cross-sectional area. The amount of austenite phase is more preferably 0.1% by volume or cross-sectional area.

The second aspect of the present invention is a part of loom, the part being composed of a Fe—Cr—Ni based alloy having a structure of substantially dual-phase of a ferrite phase and a martensite phase.

The Fe—Cr—Ni alloy preferably contains 10 to 30% by weight of Cr and 0.01 to 15% by weight of Ni.

Cr contributes to improving the corrosion resistance of parts of loom. When the amount of Cr is too large, working characteristics degrade. In contrast, when the amount of Cr is too small, sufficient corrosion resistance cannot be obtained and the ratio of the ferrite phase and the martensite is adversely affected. The amount of Cr is more preferably in the range from 13 to 19% by weight.

Ni contributes to forming an austenite phase and a martensite phase corresponding thereto. Ni causes the amount of the martensite phase to increase and contributes to improving the hardness and wear resistance. When the amount of Ni is too large, the amount of the martensite phase excessively increases. Thus, the ductility of the resultant material deteriorates. Consequently, the amount of Ni should be 15% by weight or less. To control the ratio of the ferrite phase and the martensite phase, the amount of Ni is preferably 5.0% by weight or less. To allow Ni to produce the martensite phase, practicably, the amount of Ni is preferably 0.01% by weight. The amount of Ni is more preferably in the range from 1.0 to 4.0% by weight.

The Fe—Cr—Ni based alloy preferably contains 0.001 to 1% by weight of C along with Cr and Ni. In addition, the Fe—Cr—Ni based alloy may contain at least one selected from the group consisting of Mn, Co, Cu, and Pt. The amount of each of the elements is in the range from 0.01 to 20% by weight. Alternatively, the Fe—Cr—Ni based alloy may contain 0.0001 to 1% by weight of N. As described above, these elements contribute to reinforcing the martensite phase. The content of each element is the same as that defined in the structure according to the first aspect of the present invention. The Fe—Cr—Ni based alloy may contain 2.0% by weight or less of Si. Si contributes to increasing the amount of the ferrite phase and effectively controls the martensite phase. The content of Si is the same as that defined in the structure according to the first aspect of the present invention.

The Fe—Cr based alloy may contain Al, Mg, Ca, Ti, or the like as a deoxidizing agent. In addition, the Fe—Cr based alloy may contain Nb, Ta, Zr, Mo, Re, Y, or B so as to improve working characteristics and heat resistance. Moreover, the Fe—Cr based alloy may contain a small amount of P, S, or O as impurities.

The Fe—Cr—Ni based alloy is heated to a temperature of the region of dual-phase of the ferrite phase and the austenite phase and then rapidly cooled. Thus, the austenite phase is changed to the martensite phase. Consequently, a Fe—Cr—Ni based alloy having a metal structure of substantially dual-phase of a ferrite phase and a martensite phase is obtained. The ferrite phase contributes to improving the corrosion resistance. The martensite phase contributes to improving the hardness, wear resistance, resistance to permanent set in fatigue, and so forth.

As with the above-described Fe—Cr based alloy, in the causes wear to progress in the lateral direction. Thus, wear of a limited portion of the alloy in the depth direction that causes threads to cut and cloth to nap can be suppressed. The martensite phase causes the resistance to permanent set in fatigue to improve. The alloy composition containing Cr and the ferrite phase sufficiently satisfy the corrosion resistance for the parts of loom. Thus, under severe conditions such as high speed weaving operation and severe manufacturing environment, the long service lives of the parts can be accomplished.

The Fe—Cr based alloy preferably contains 5 to 70% by volume or cross-sectional area of the ferrite phase. At this point, the rest of the composition is the martensite phase. When the amount of the ferrite phase is less than 5% by volume or cross-sectional area, the corrosion resistance for the part of loom is insufficient. In contrast, when the amount of the ferrite phase exceeds 70% by volume or cross-sectional area, the ratio of the martensite phase relatively decreases. Thus, the wear resistance and resistance to permanent set in fatigue for the parts of loom are insufficient. To satisfy both mechanical characteristics such as the wear resistance and resistance to permanent set in fatigue and corrosion resistance for the parts of loom, the ratio of the individual phases is preferably in the above-described range. The amount of the ferrite phase is more preferably in the range from 15 to 40% by volume or cross sectional area.

The parts of loom according to the second aspect of the present invention substantially have a structure of dual-phase of a ferrite phase and a martensite phase. However, even if the structure has a small amount of an austenite phase, it does not largely degrade the wear resistance and the corrosive resistance of the parts of loom. Thus, the structure may have the austenite phase less than 5% by volume or cross-sectional area. However, the austenite phase is preferably as small as possible. The austenite phase is more preferably less than 1% by volume or cross-sectional area. In particular, the austenite phase is further preferably less than 0.1% by volume or cross-sectional area.

The parts of loom composed of the above-described Fe—Cr based alloy or Fe—Cr—Ni based alloy are preferably used for dents of reed and heddles that frequently contact threads to be woven. In addition, the parts of loom according to the present invention are suitable for a cloth beam or woof thread coil.

The parts of loom composed of the above-described Fe—Cr based alloy or Fe—Cr—Ni based alloy can be manufactured in for example the following steps.

Alloy components that satisfy the above-described composition ratio (components of Fe—Cr based alloy or components of Fe—Cr—Ni based alloy) are melted in a high frequency induction furnace or a vacuum induction furnace and an alloy ingot with a desired alloy composition is obtained. Next, the obtained ingot is hot-forged, hot-rolled, and cold-rolled. Thus, an alloy plate with a desired thickness is obtained. The hot-forging step, the hot-rolling step, and the cold-rolling step can be performed in known methods.

Next, after the alloy plate is heated to a temperature of the region of dual-phase of the ferrite phase and the austenite phase, the plate is rapidly cooled. Thus, the austenite phase is changed to the martensite phase. Consequently, an alloy plate with a desired composition having a structure of substantially dual-phase of the ferrite phase and the martensite phase is obtained. When the plate is formed in a desired shape of parts of loom such as dents of reed or heddles, parts of loom according to the present invention can be obtained.

The heat treatment is performed at a temperature higher than the existence temperature of the austenite phase (Acl). Practically, the heat treatment is performed preferably at a temperature in the range from (Acl+100 K) to 1373 K. From this temperature, the alloy is cooled preferably at a cooling speed of 1 to 1000 K/sec. When the cooling speed is less than 1 K/sec, a large amount of the austenite phase may reside. When necessary, a proper aging process is performed so as to improve the hardness of the alloy.

Next, parts of loom according to a third aspect of the present invention will be described.

The third aspect of the present invention is a part of loom, the part composed of a Fe—Cr based alloy or a Fe—Cr—Ni based alloy, the maximum crystal particle diameter of the Fe—Cr based alloy or the Fe—Cr—Ni alloy being 20 $\mu$m or less. The contents of Cr and Ni of each alloy, the added element, and so forth of the parts of loom according to the third aspect of the present invention are the same as those of the parts according to the first and second aspects of the present invention.

When the average diameter of the crystal particles of the Fe—Cr based alloy or Fe—Cr—Ni based alloy is decreased so that the maximum crystal particle diameter becomes 20 $\mu$m or less, when the alloy gets worn with threads, the wear progresses in the lateral direction. Thus, wear of a limited portion of the alloy in the depth direction that causes threads to cut and cloth to nap is suppressed. The maximum crystal particle diameter of the Fe—Cr based alloy or Fe—Cr—Ni based alloy is preferably 10 $\mu$m or less. When the maximum crystal particle diameter exceeds 20 $\mu$m, a limited portion of the alloy tends to get worn and quickly wears in the depth direction.

Cr contained in the Fe—Cr based alloy or Fe—Cr—Ni based alloy satisfies the corrosion resistance necessary for the parts of loom. Thus, under severe conditions such as high speed weaving operation and severe manufacturing environment, long service lives of the parts of loom can be accomplished.

As with the parts of loom according to the first and second aspect of the present invention, the parts of loom according to the third aspect of the present invention preferably have a metal structure of substantially dual-phase of a ferrite phase and a martensite phase. This metal structure contributes to improving the wear resistance, resistance to permanent set in fatigue, corrosive resistance, and so forth. In other words, when the maximum crystal particle diameter of the Fe—Cr based alloy or Fe—Cr—Ni based alloy composing the parts of loom according to the first and second aspects of the present invention is 20 $\mu$m or less, the characteristics of the parts of loom can be further improved.

The parts of loom according to the third aspect of the present invention can be manufactured in the same manner as the parts of loom according to the first and second aspects of the present invention. At this point, the alloy is heated to a temperature of the region of dual-phase of the ferrite phase and the austenite phase and then rapidly cooled. Thus, the crystal particles of the Fe—Cr based alloy or Fe—Cr—Ni based alloy can be finely formed so that the maximum crystal particle diameter becomes 20 $\mu$m or less. The rapid cooling process is performed preferably in the range from 1 to 1000 K/sec.

The loom according to the present invention has at least one loom part selected from the group consisting of the parts of loom according to the first, second, and third aspect of the present invention. As the loom part, a dent of reed and a heddle and the like are exemplified. FIG. 1 is a schematic diagram showing an outlined structure of a loom according to an embodiment of the present invention. In FIG. 1, a plurality of warp threads 2 are supplied from a cloth beam 1. The warp threads 2 are inserted into respective thread holes (not shown) of a plurality of heddles 3. These heddles 3 are integrally operated and thereby the warp threads 2 are vertically reciprocated.

A woof thread 4 is supplied from a woof thread supply (not shown) by the power of water (water jet loom) or compressed water (air jet loom). The woof thread 4 is pushed by dents of reed 5. The dents of reed 5 are arranged in a comb shape and secured with a rectangular frame. Thus, a reed 6 is formed. By repeating such steps, cloth is wound by a take-up coil 7.

By using the parts of loom according to the present invention for the dents of reed 5 and heddle 3 of the loom, the loom according to the present invention is structured. When the dents of reed 5 and heddles 3 that have excellent wear resistance, corrosive resistance, resistance to permanent set-in fatigue, and so forth, the loom can be operated under severe conditions such as high speed weaving operation and severe manufacturing environment.

Next, preferred embodiments and evaluated results according to the present invention will be described.

Embodiments 1 to 9

Each alloy component shown in Table 1 was melted in a high frequency induction furnace. Thus, desired alloy ingots having a Fe—Cr based alloy composition or Fe—Cr—Ni based alloy composition were manufactured. Each alloy ingot was hot-forged, hot-rolled, and cold-rolled and thereby a plate with a thickness of 0.2 mm was obtained.

Each alloy plate was heated to 1273 K that is a temperature of the region of dual-phase of the ferrite phase and the austenite phase. Thereafter, each alloy plate was cooled at a cooling speed of 20 K/sec. Thus, a Fe—Cr based alloy plate or Fe—Cr—Ni based alloy plate having a structure of substantially dual-phase of the ferrite phase and the martensite phase was obtained. The metal structure of the resultant alloy plate was observed by a microscope. Table 1 shows the cross section ratio of the ferrite phase of each alloy plate. Each alloy plate was formed in the shape of dents of reed and assembled at a dent density of about 95 pieces/3.78 cm. Thus, a reed was obtained.

Comparison 1

With a material SUS 301 that is basically composed of 17% by weight of Cr, 7% by weight of Ni, and balance of Fe and that has been cold-worked, in the same manner as the embodiments 1 to 9, dents of reed and a reed were manufactured. The dents of reed according to the comparison 1 have a metal structure of the austenite phase and the martensite phase.

Comparison 2

With a material SUS 420 J2 that is composed of 13% by weight of Cr, 0.3% by weight of C, and balance of Fe, in the same manner as the embodiments 1 to 9, dents of reed and a reed were manufactured. The dents of reed according to the comparison 2 have a metal structure of the martensite phase.

Comparison 3

With a material SUS 430 that is composed of 18% by weight of Cr and balance of Fe, in the same manner as the embodiments 1 to 9, dents of reed and a reed were manufactured. The dents of reed according to the comparison 3 have a metal structure of the ferrite phase.

TABLE 1

| | Alloy composition (% by weight) | | | | | | Ratio of ferrite |
|---|---|---|---|---|---|---|---|
| | Cr | Ni | C | Mn | Si | Fe | phase (% by area) |
| Embod. 1 | 16.5 | 0 | 0.058 | 0.30 | 0.55 | bal. | 35 |
| Embod. 2 | 16.5 | 2.05 | 0.070 | 0.35 | 0.50 | bal. | 29 |
| Embod. 3 | 16.3 | 1.98 | 0.073 | 0.28 | 0.48 | bal. | 32 |
| Embod. 4 | 16.4 | 2.11 | 0.067 | 0.30 | 0.52 | bal. | 27 |

TABLE 1-continued

| | Alloy composition (% by weight) | | | | | | Ratio of ferrite |
|---|---|---|---|---|---|---|---|
| | Cr | Ni | C | Mn | Si | Fe | phase (% by area) |
| Embod. 5 | 16.2 | 1.94 | 0.066 | 0.29 | 0.56 | bal. | 30 |
| Embod. 6 | 16.2 | 3.01 | 0.069 | 0.29 | 0.49 | bal. | 25 |
| Embod. 7 | 16.3 | 1.89 | 0.055 | 0.51 | 0.39 | bal. | 30 |
| Embod. 8 | 18.4 | 6.30 | 0.015 | 0.55 | 0.51 | bal. | 20 |
| Embod. 9 | 18.9 | 2.03 | 0.017 | 1.15 | 0.46 | bal. | 28 |
| Comp. 1 | 17.1 | 7.10 | 0.100 | 0.96 | 0.75 | bal. | 0 |
| Comp. 2 | 13.2 | 0 | 0.330 | 0.75 | 0.79 | bal. | 0 |
| Comp. 3 | 17.2 | 0 | 0.050 | 0.70 | 0.53 | bal. | 100 |

With individual reeds according to the embodiments 1 to 9 and the comparison, their wear resistance, corrosion resistance, and resistance to permanent set in fatigue were evaluated by the following test methods.

[Measuring Method of Wear Resistance and Corrosion Resistance]

Figure 2:
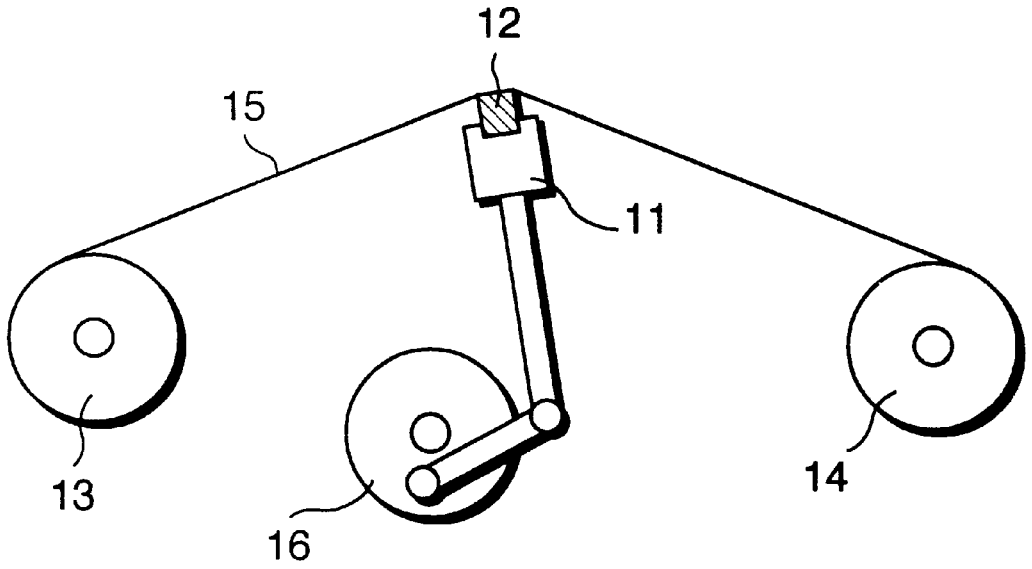
FIG. 2 is a schematic diagram showing an acceleration test method for measuring wear resistance and corrosion resistance of parts of loom according to an embodiment of the present invention.

As shown in FIG. 2, a dent of reed as a test piece 12 was held by a test piece holder 11. A thread was supplied from a thread feed portion 13 to a thread wind portion 14 while the thread was tensioned. At this point, by rotating a driving rotating shaft 16 in synchronization with the test piece holder 11, wear of the test piece 12 was accelerated.

When dents of reed are used for a loom, since paste containing chlorine adheres to the thread 15, the paste causes the dents to corrode. By spraying salt water containing 10% by weight of paste to the dents, a corrosion resisting test was performed.

In these acceleration tests, when a polyester thread was supplied at a speed of 4 m/min with a tension of 60 g and the driving rotating shaft was rotated at 800 rpm, the dents got worn and corroded in 24 hours as with the operation of the loom for one year. Table 2 shows the test results in the above-described condition. In Table 2, the wear resistance is represented with the wear amount in mm. The corrosion resistance is represented with the number of test samples that corroded in 50 test samples.

[Measuring Method of Resistance to Permanent Set in Fatigue]

A real machine test was performed with polyester (semidaru) threads at a density of 96 warp threads/inch and 90 woof threads/inch, a rotation of 650 rpm, a dent density of about 95 pieces/3.78 cm. At this point, by measuring the number of grain-rise portions in 1 m width of cloth, the resistance to permanent set in fatigue was evaluated. Table 2 also shows the measured results of the resistance to permanent set in fatigue.

TABLE 2

| | Wear resistance test (mm) | | | Corrosion resistance test | | Resistance to permanent set |
|---|---|---|---|---|---|---|
| | Width Direction | Depth Direction | Width/ Depth | Spray of salt water | Spray of salt water + 10% by weight of paste | in fatigue test (piece/mm) |
| Embod. 1 | 1.103 | 0.065 | 17.0 | 0/50 | 0/50 | 0 |
| Embod. 2 | 1.049 | 0.060 | 17.5 | 0/50 | 0/50 | 0 |
| Bmbod. 3 | 1.048 | 0.062 | 17.5 | 0/50 | 0/50 | 0 |
| Embod. 4 | 1.098 | 0.058 | 18.9 | 0/50 | 0/50 | 0 |
| Embod. 5 | 1.342 | 0.079 | 17.0 | 0/50 | 0/50 | 0 |
| Embod. 6 | 1.060 | 0.063 | 16.8 | 0/50 | 0/50 | 0 |
| Embod. 7 | 1.219 | 0.059 | 20.7 | 0/50 | 0/50 | 0 |
| Embod. 8 | 1.143 | 0.066 | 17.3 | 0/50 | 0/50 | 0 |
| Embod. 9 | 1.455 | 0.061 | 23.9 | 0/50 | 0/50 | 0 |
| Comp. 1 | 1.458 | 0.226 | 6.5 | 0/50 | 15/50 | 0 |
| Comp. 2 | 0.981 | 0.070 | 14.0 | 50/50 | 50/50 | 0 |
| Comp. 3 | 0.935 | 0.088 | 10.6 | 0/50 | 0/50 | 6 |

Table 2 shows that wear of each dent according to the embodiments 1 to 9 progresses in the lateral direction and thereby suppressing wear of a limited portion in the depth direction. In addition, Table 2 shows that each dent according to the embodiments 1 to 9 has excellent corrosion resistance and resistance to permanent set in fatigue.

Embodiments 10 to 18

Each alloy component shown in Table 3 was melted in a high frequency induction furnace. Thus, desired alloy ingots having a Fe—Cr based alloy composition or Fe—Cr—Ni based alloy composition were manufactured. Each alloy ingot was hot-forged, hot-rolled, and cold-rolled and thereby a plate with a thickness of 0.3 mm was obtained.

Each alloy plate was heated to 1273 K that is a temperature of the region of dual-phase of the ferrite phase and the austenite phase. Thereafter, each alloy plate was cooled at a cooling speed of 20 K/sec. Thus, a Fe—Cr based alloy plate or Fe—Cr—Ni based alloy plate having a structure of substantially dual-phase of the ferrite phase and the martensite phase was obtained. The metal structure of the resultant alloy plate was observed by a microscope. Table 3 shows the cross section ratio of the ferrite phase of each alloy plate. Each alloy plate was formed in the shape of heddles. Thus, heddles were obtained.

Comparison 4

With a material SUS 301 that is basically composed of 17% by weight of Cr, 7% by weight of Ni, and balance of Fe and that has been cold-worked, in the same manner as the embodiments 10 to 18, heddles were manufactured. The heddles according to the comparison 4 have a metal structure of an austenite phase and a martensite phase.

Comparison 5

With a material SUS 420 J2 that is composed of 13% by weight of Cr, 0.3% by weight of C, and balance of Fe, in the same manner as the embodiments 10 to 18, heddles were manufactured. The heddles according to the comparison 5 have a metal structure of a martensite phase.

Comparison 6

With a material SUS 430 that is composed of 18% by weight of Cr and balance of Fe, in the same manner as the embodiments 10 to 18, heddles were manufactured. The heddles according to the comparison 6 have a metal structure of a ferrite phase.

TABLE 3

| | Alloy composition | | | | | | Ratio of ferrite phase |
|---|---|---|---|---|---|---|---|
| | Cr | Ni | C | Mn | Si | Fe | (% by area) |
| Embod. 10 | 16.5 | 0 | 0.058 | 0.30 | 0.55 | bal. | 35 |
| Embod. 11 | 16.5 | 2.05 | 0.070 | 0.35 | 0.50 | bal. | 29 |
| Embod. 12 | 16.3 | 1.98 | 0.073 | 0.28 | 0.48 | bal. | 32 |
| Bmbod. 13 | 16.4 | 2.11 | 0.067 | 0.30 | 0.52 | bal. | 27 |
| Embod. 14 | 16.2 | 1.94 | 0.066 | 0.29 | 0.56 | bal. | 30 |
| Embod. 15 | 16.2 | 2.01 | 0.069 | 0.29 | 0.49 | bal. | 25 |
| Embod. 16 | 16.3 | 1.89 | 0.055 | 0.51 | 0.39 | bal. | 30 |
| Embod. 17 | 18.4 | 6.30 | 0.015 | 0.55 | 0.51 | bal. | 20 |
| Embod. 18 | 18.9 | 2.03 | 0.017 | 1.15 | 0.46 | bal. | 28 |
| Comp. 4 | 17.1 | 7.10 | 0.100 | 0.96 | 0.75 | bal. | 0 |
| Comp. 5 | 13.2 | 0 | 0.330 | 0.75 | 0.79 | bal. | 0 |
| Comp. 6 | 17.2 | 0 | 0.050 | 0.70 | 0.53 | bal. | 100 |

In the same manner as the embodiments 1 to 9, the wear resistance, corrosion resistance, and resistance to permanent set in fatigue of each heddle according to the embodiments 10 to 18 were measured and evaluated. Table 4 shows the evaluated results.

TABLE 4

| | Wear resistance test (mm) | | | Corrosion resistance test | | Resistance to permanent set |
|---|---|---|---|---|---|---|
| | Width Direction | Depth Direction | Width/ Depth | Spray of salt water | Spray of salt water + 10% by weight of paste | in fatigue test (piece/mm) |
| Embod. 10 | 1.103 | 0.065 | 17.0 | 0/50 | 0/50 | 0 |
| Embod. 11 | 1.049 | 0.060 | 17.5 | 0/50 | 0/50 | 0 |
| Embod. 12 | 1.048 | 0.062 | 17.5 | 0/50 | 0/50 | 0 |

TABLE 4-continued

| | Wear resistance test (mm) | | | Corrosion resistance test | | Resistance to permanent set in fatigue test (piece/mm) |
|---|---|---|---|---|---|---|
| | Width Direction | Depth Direction | Width/ Depth | Spray of salt water | Spray of salt water + 10% by weight of paste | |
| Bmbod. 13 | 1.098 | 0.058 | 18.9 | 0/50 | 0/50 | 0 |
| Embod. 14 | 1.342 | 0.079 | 17.0 | 0/50 | 0/50 | 0 |
| Embod. 15 | 1.060 | 0.063 | 16.8 | 0/50 | 0/50 | 0 |
| Embod. 16 | 1.233 | 0.061 | 20.2 | 0/50 | 0/50 | 0 |
| Embod. 17 | 1.139 | 0.062 | 18.3 | 0/50 | 0/50 | 0 |
| Embod. 18 | 1.461 | 0.068 | 21.5 | 0/50 | 0/50 | 0 |
| Comp. 4 | 1.458 | 0.226 | 6.5 | 0/50 | 15/50 | 0 |
| Comp. 5 | 0.981 | 0.070 | 14.0 | 50/50 | 50/50 | 0 |
| Comp. 6 | 0.935 | 0.088 | 10.6 | 0/50 | 0/50 | 6 |

Table 4 shows that wear of each heddle according to the embodiments 10 to 18 progresses in the lateral direction and thereby suppressing wear of a limited portion in the depth direction. In addition, Table 4 shows that each heddle according to the embodiments 10 to 18 has excellent corrosion resistance and resistance to permanent set in fatigue.

Embodiments 19 to 26

Each alloy component shown in Table 5 was melted in a high frequency induction furnace. Thus, desired alloy ingots having a Fe—Cr based alloy composition or Fe—Cr—Ni based alloy composition were manufactured. Each alloy ingot was hot-forged, hot-rolled, and cold-rolled and thereby a plate with a thickness of 0.2 mm was obtained.

Each alloy plate was heated to 1273 K that is a temperature of the region of dual-phase of the ferrite phase and the austenite phase. Thereafter, each alloy plate was quickly cooled. In the embodiments 19, 21, 23, and 25, the cooling speed was 20 K/sec. In the embodiments 20, 22, 24, and 26, the cooling speed was 40 K/sec. Thus, a Fe—Cr based alloy plate or Fe—Cr—Ni based alloy plate having a structure of substantially dual-phase of the ferrite phase and the martensite phase was obtained. The metal structure of the resultant alloy plate was observed by a microscope. Table 5 shows the cross section ratio of the ferrite phase of each alloy plate. Each alloy plate was formed in the shape of dents of reed and assembled at a dent density of about 95 pieces/3.78 cm. Thus, a reed was obtained.

TABLE 5

| | Alloy composition (% by weight) | | | | | | Maximum grain diameter | Ration of ferrite phase |
|---|---|---|---|---|---|---|---|---|
| | Cr | Ni | C | Mn | Si | Fe | (μm) | (% by area) |
| Embod. 19 | 16.5 | 0 | 0.065 | 4.0 | 0.45 | bal. | 19 | 28 |
| Embod. 20 | 16.5 | 0 | 0.065 | 4.0 | 0.45 | bal. | 7 | 28 |
| Embod. 21 | 16.5 | 2.05 | 0.070 | 0.35 | 0.50 | bal. | 17 | 29 |
| Embod. 22 | 16.5 | 2.05 | 0.070 | 0.35 | 0.50 | bal. | 6 | 29 |
| Embod. 23 | 16.3 | 1.98 | 0.073 | 0.28 | 0.48 | bal. | 15 | 32 |
| Embod. 24 | 16.3 | 1.98 | 0.073 | 0.28 | 0.48 | bal. | 5 | 32 |
| Embod. 25 | 16.4 | 2.11 | 0.067 | 0.30 | 0.52 | bal. | 17 | 27 |
| Embod. 26 | 16.4 | 2.11 | 0.067 | 0.30 | 0.52 | bal. | 8 | 27 |

In the same manner as the embodiments 1 to 9, the wear resistance of each dent according to the embodiments 19 to 26 was measured and evaluated. Table 6 shows the evaluated results.

TABLE 6

| | Wear resistance test (mm) | | | Corrosion resistance test | | Resistance to permanent set in fatigue test (piece/mm) |
|---|---|---|---|---|---|---|
| | Width direction | Depth direction | Width/ depth | Spray of salt water | Spray of salt water + 10% by weight of paste | |
| Embod. 19 | 1.103 | 0.065 | 17.0 | 0/50 | 0/50 | 0 |
| Embod. 20 | 1.110 | 0.060 | 18.5 | 0/50 | 0/50 | 0 |
| Embod. 21 | 1.004 | 0.071 | 14.1 | 0/50 | 0/50 | 0 |
| Embod. 22 | 1.071 | 0.060 | 17.3 | 0/50 | 0/50 | 0 |
| Embod. 23 | 1.022 | 0.069 | 14.8 | 0/50 | 0/50 | 0 |
| Embod. 24 | 1.098 | 0.059 | 18.6 | 0/50 | 0/50 | 0 |

TABLE 6-continued

| | Wear resistance test (mm) | | | Corrosion resistance test | | Resistance to permanent set in fatigue test (piece/mm) |
|---|---|---|---|---|---|---|
| | Width direction | Depth direction | Width/depth | Spray of salt water | Spray of salt water + 10% by weight of paste | |
| Embod. 25 | 0.950 | 0.074 | 12.8 | 0/50 | 0/50 | 0 |
| Embod. 26 | 1.066 | 0.063 | 16.9 | 0/50 | 0/50 | 0 |

As is clear from Table 6, each dent according to the embodiments 19 to 26 of which the maximum crystal particle diameter is 20 μm or less has excellent wear resistance and resistance to permanent set in fatigue. In addition, each dent according to the embodiments 20, 22, 24, and 26 of which the maximum crystal particle diameter is 10 μm or less has more excellent wear resistance.

As described above, the parts of loom according to the present invention have excellent wear resistance and resistance to permanent set in fatigue against threads. Thus, under severe conditions, the long service lives of the parts of loom can be accomplished. In addition, the loom according to the present invention of which such parts of loom are used as dents of reed and heddles can be effectively used under severe conditions such as high speed weaving operation and severe manufacturing environment.

Although the present invention has been shown and described with respect to best mode embodiments thereof, it should be understood by those skilled in the art that the foregoing and various other changes, omissions, and additions in the form and detail thereof may be made therein without departing from the spirit and scope of the present invention.

What is claimed is:

1. A wear resistant and corrosion resistant loom part comprising a Fe—Cr based alloy having a substantially dual-phase structure comprising a ferrite phase and a martensite phase.

2. The loom part as set forth in claim 1, wherein the Fe—Cr based alloy has 10 to 30% by weight of Cr.

3. The loom part as set forth in claim 1, wherein the Fe—Cr based alloy contains 0.01 to 20% by weight of at least one element selected from the group consisting of Mn, Co, Cu, and Pt.

4. The loom part as set forth in claim 1, wherein the Fe—Cr based alloy contains 0.0001 to 1% by weight of N.

5. The loom part as set forth in claim 1, wherein the Fe—Cr based alloy contains 0.001 to 1% by weight of C.

6. The loom part as set forth in claim 1, wherein the Fe—Cr based alloy contains 5 to 70% by volume of the ferrite phase.

7. The loom part as set forth in claim 1, wherein the Fe—Cr based alloy contains 5 to 70% by area of random cross section of the ferrite phase.

8. The loom part as set forth in claim 1, wherein the loom part is at least one selected from the group consisting of a dent of a reed and a heddle.

9. A wear resistant and corrosion resistant loom part, comprising a Fe—Cr—Ni based alloy having a substantially dual-phase structure comprising a ferrite phase and a martensite phase.

10. The loom part as set forth in claim 9, wherein the Fe—Cr—Ni based alloy contains 10 to 30% by weight of Cr and 0.01 to 15% by weight of Ni.

11. The loom part as set forth in claim 9, wherein the Fe—Cr—Ni based alloy contains 0.001 to 1% by weight of C.

12. The loom part as set forth in claim 9, wherein the Fe—Cr—Ni based alloy contains 5 to 70% by volume of the ferrite phase.

13. The loom part as set forth in claim 9, wherein the Fe—Cr—Ni based alloy contains 5 to 70% by area of random cross section of the ferrite phase.

14. The loom part as set forth in claim 9, wherein the part is at least one selected from the group consisting of a dent of a reed and a heddle.

15. A wear resistant and corrosion resistant loom part comprising a Fe—Cr—Ni based alloy comprising at least 10 to 30% by weight of Cr and 0.01 to 15% by weight of Ni, the Fe—Cr—Ni based alloy being an alloy obtained by heating and rapidly cooling at a cooling speed of 1 to 1000 K/Sec, wherein the alloy has a substantially dual-phase structure comprising a ferrite phase and a martensite phase.

16. The loom part as set forth in claim 15, wherein the Fe—Cr—Ni based alloy contains 0.001 to 1% by weight of C.

17. The loom part as set forth in claim 15, wherein the loom part is at least one selected from the group consisting of a dent of a reed and a heddle.

18. A wear resistant and corrosion resistant loom part comprising a Fe—Cr based alloy or a Fe—Cr—Ni based alloy, the maximum crystal particle diameter of the Fe—Cr based alloy or the Fe—Cr—Ni based alloy being 20 μm or less.

19. The loom part as set forth claim 18, wherein the maximum crystal particle diameter of the Fe—Cr based alloy or the Fe—Cr—Ni based alloy is 10 μm or less.

20. The loom part as set forth in claim 18, wherein the loom part comprises the Fe—Cr based alloy containing at least 10 to 30% by weight of Cr.

21. The loom part as set forth in claim 18, wherein the loom part comprises the Fe—Cr—Ni based alloy containing at least 10 to 30% by weight of Cr and 0.01 to 15% by weight of Ni.

22. The loom part as set forth in claim 18, wherein the Fe—Cr based alloy or the Fe—Cr—Ni based alloy has a substantially dual-phase structure of a ferrite phase and a martensite phase.

23. The loom part as set forth in claim 18, wherein the loom part is at least one selected from the group consisting of a dent of a reed and a heddle.

24. A loom having wear resistant and corrosion resistant loom parts comprising:

a cloth beam for supplying a plurality of warp threads;

a plurality of heddles, having respective thread holes for the warp threads, for vertically reciprocating the warp threads;

thread supplying means for supplying a woof thread among the warp threads; and a plurality of dents of reed for pushing the woof thread, wherein the dents comprise a Fe—Cr based alloy having a substantially dual-phase structure of a ferrite phase and a martensite phase.

25. A loom having wear resistant and corrosion resistant loom parts comprising:

a cloth beam for supplying a plurality of warp threads;

a plurality of heddles, having respective thread holes for the warp threads, for vertically reciprocating the warp threads;

thread supplying means for supplying a woof thread among the warp threads; and a plurality of dents of reed for pushing the woof thread, wherein the dents comprise a Fe—Cr—Ni based alloy having a substantially dual-phase structure of a ferrite phase and a martensite phase.

26. A loom having wear resistant and corrosion resistant loom parts comprising:

a cloth beam for supplying a plurality of warp threads;

a plurality of heddles, having respective thread holes for the warp threads, for vertically reciprocating the warp threads;

thread supplying means for supplying a woof thread among the warp threads; and a plurality of dents of reed for pushing the woof thread, wherein the dents comprise a Fe—Cr—Ni based alloy comprising at least 10 to 30% by weight of Cr, and 0.01 to 15% by weight of Ni, the Fe—Cr—Ni based alloy being an alloy obtained by heating and rapidly cooling at a cooling speed of 1 to 1000 K/sec, wherein the alloy has a substantially dual-phase structure comprising a ferrite phase and a martensite phase.

27. A loom having wear resistant and corrosion resistant loom parts comprising:

a cloth beam for supplying a plurality of warp threads;

a plurality of heddles, having respective thread holes for the warp threads, for vertically reciprocating the warp threads;

thread supplying means for supplying a woof thread among the warp threads; and a plurality of dents of reed for pushing the woof thread, wherein the dents comprise a Fe—Cr based alloy or a Fe—Cr—Ni based alloy, the maximum crystal particle diameter of the Fe—Cr based alloy or the Fe—Cr—Ni based alloy being 20 $\mu$m or less.

28. A loom having wear resistant and corrosion resistant loom parts comprising:

a cloth beam for supplying a plurality of warp threads;

a plurality of heddles, having respective thread holes for the warp threads, for vertically reciprocating the warp threads, said heddles comprising a Fe—Cr based alloy having a substantially dual-phase structure of a ferrite phase and a martensite phase;

thread supplying means for supplying a woof thread among the warp threads;

woof thread supplying means for supplying a woof thread among the warp threads; and a plurality of dents of reed for pushing the woof thread.

29. A loom having wear resistant and corrosion resistant loom parts comprising:

a cloth beam for supplying a plurality of warp threads;

a plurality of heddles, having respective thread holes for the warp threads, for vertically reciprocating the warp threads, said heddles comprising a Fe—Cr—Ni based alloy having a substantially dual-phase structure of a ferrite phase and a martensite phase:

thread supplying means for supplying a woof thread among the warp threads;

woof thread supplying means for supplying a woof thread among the warp threads; and a plurality of dents of reed for pushing the woof thread.

30. A loom having wear resistant and corrosion resistant loom parts comprising:

a cloth beam for supplying a plurality of warp threads;

a plurality of heddles, having respective thread holes for the warp threads, for vertically reciprocating the warp threads, said heddles comprising a Fe—Cr—Ni based alloy comprising at least 10 to 30% by weight of Cr, and 0.01 to 15% by weight of Ni, the Fe—Cr—Ni based alloy being an alloy obtained by heating and rapidly cooling at a cooling speed of 1 to 1000 K/sec;

thread supplying means for supplying a woof thread among the warp threads;

woof thread supplying means for supplying a woof thread among the warp threads; and a plurality of dents of reed for pushing the woof thread wherein the alloy has a substantially dual-phase structure comprising a ferrite phase and a martensite phase.

31. A loom having wear resistant and corrosion resistant loom parts comprising:

a cloth beam for supplying a plurality of warp threads;

a plurality of heddles, having respective thread holes for the warp threads, for vertically reciprocating the warp threads, said heddles comprising a Fe—Cr based alloy or a Fe—Cr—Ni based alloy, the maximum crystal particle diameter of the Fe—Cr based alloy or the Fe—Cr—Ni based alloy being 20 $\mu$m or less;

thread supplying means for supplying a woof thread among the warp threads;

woof thread supplying means for supplying a woof thread among the warp threads; and a plurality of dents of reed for pushing the woof thread.

* * * * *